US005186637A

United States Patent [19]

Norden

[11] Patent Number: 5,186,637

[45] Date of Patent: Feb. 16, 1993

[54] LOCKABLE ELECTRICAL APPARATUS

[75] Inventor: Alexander R. Norden, Boca Raton, Fla.

[73] Assignee: Connectron, Inc., Lawrence Harbor, N.J.

[21] Appl. No.: 766,339

[22] Filed: Sep. 27, 1991

[51] Int. Cl.[5] ..... H01R 13/66; H01R 13/639

[52] U.S. Cl. ..... 439/133; 439/622; 337/211

[58] Field of Search ..... 439/133, 134, 136, 141, 439/911, 621, 622; 70/DIG. 30, 57, 203, 212; 200/43.19, 43.22; 337/211

[56] References Cited

U.S. PATENT DOCUMENTS 2,943,162 6/1960 Norden ..... 200/43.15
3,848,088 11/1974 Bentz ..... 439/911
4,755,909 7/1988 Hibbert et al. ..... 361/331
4,966,561 10/1990 Norden ..... 439/622

FOREIGN PATENT DOCUMENTS 17689 2/1977 Japan ..... 439/148
83033 4/1920 Switzerland ..... 439/133
2179208 2/1987 United Kingdom ..... 439/911

*Primary Examiner*—Gary F. Paumen

[57] ABSTRACT

The described fuse holders or analogous electrical equipment is blocked by a padlock and a clip against being casually changed from its locked condition so that the controlled circuit remains energized or denergized. The clip is captive between the fuse carrier of the fuse holder and the fuse holder's receptacle but the clip is no longer captive when the fuse carrier is removed from the receptacle.

20 Claims, 3 Drawing Sheets

LOCKABLE ELECTRICAL APPARATUS

The present invention relates to electrical apparatus for controlling the supply of power in an electrical circuit, and it relates particularly to fuse holders. A "fuse holder" is a widely used type of circuit protector that comprises a receptacle having a pair of spaced-apart contacts and a "pull-out" removably contained in the receptacle. The pull-out is usually a "fuse carrier" equipped with a fuse or fuses, and the fuse carrier may either have discrete contacts that mate with the receptacle's contacts or the terminals of a fuse carried by the fuse carrier may serve as the fuse carrier's contacts.

BACKGROUND

Electrical apparatus such as individual switches and circuit breakers has long been available with locking devices. The door of an enclosure for a panel of switches, fuses, fuse holders and circuit breakers is often provided with a locking device. Providing such electrical equipment with a lock enables an electrician to interrupt power to a circuit for safety when working on that circuit. Also, it may be important to maintain power in a secure circuit, for example in the energizing circuit of a fire alarm or a food freezer. Use of a locking device guards such apparatus against being unintentionally operated to energize or deenergize the controlled circuit. The electrical apparatus is restored to what may be called a normal condition after the apparatus has been unlocked.

A simple padlock is often suitable for the locking purpose. As an example, both the enclosure of a panel of circuit breakers or fuses or fuse holders and the door of the enclosure may have projecting blades with aligned holes for a padlock, to lock the door shut. In similar equipment, a single blade projects from the enclosure of a panel, the blade passing through a slot in its door when closed. A padlock having a hasp extending through a hole in that blade blocks the door against being opened. Circuits controlled by such apparatus are protected, so that their energized or deenergized condition can not be changed while the padlock is in place.

SUMMARY OF THE INVENTION

In one aspect, the present invention provides novel lockable electrical apparatus to prevent unauthorized or inadvertent operation, for assurance that a circuit or circuits protected by the apparatus will remain either energized or deenergized.

In a more specific aspect, the invention provides novel lockable individual single-pole or multi-pole fuse holders, for enabling the fuse carrier or a dummy substitute for a fuse carrier to be secured in the fuse holder's receptacle by a locking device. The invention is applicable to usual fuse holders and it is applicable with particular effectiveness to fuse holders of the form in U.S. Pat. No. 4,966,561, issued Oct. 16, 1990.

Novel electrical apparatus is provided having a padlock and a clip that receives the hasp of the padlock and locates the hasp as the obstruction that directly blocks an operating member of the electrical apparatus. The invention is distinctively applicable and effective as applied to a fuse holders. The entire locking device consists of a padlock and a clip which is interengaged with the locked apparatus. The clip cannot be removed from the apparatus while that apparatus is locked or in position to be locked.

In the form of locking device consisting of a padlock and a locking clip, the clip may be retentively secured to the apparatus. In a distinctive form, both the padlock and the clip as well are removable from the electrical apparatus.

The invention will be better appreciated in the light of the following detailed description of an illustrative embodiment of the invention, and a modification, which are shown in the accompanying drawings. The illustrative embodiment represents an exemplary form of various aspects of the invention.

DESCRIPTION OF THE ILLUSTRATIVE APPARTUS

Figure 1:
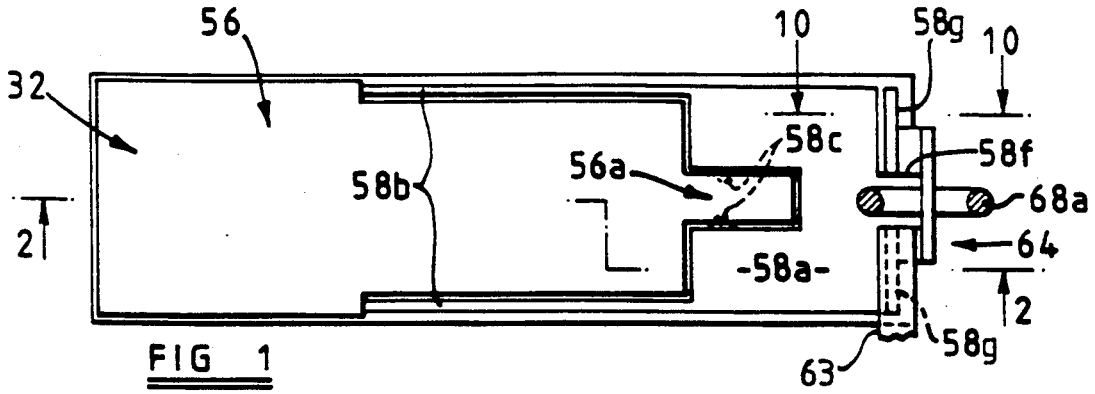
FIG. 1 is a top plan view of a fuse holder having a locking device, being an illustrative embodiment of the invention.

Referring now to the drawings, particularly FIGS. 1-10, receptacle 30 has a body of insulation 34 formed of two united parts that are essentially mirror images of each other. Walls 34*a* of body 34 are spaced-apart sides of a cavity of the receptacle 30. Walls 34*a* have mutually opposite mirror-image ribs 36 that serve as cam surfaces. Side walls 34*a* and end walls 34*b* form a generally rectangular opening to receive a "pull-out" or fuse carrier 32.

Receptacle 30 contains spaced-apart terminal assemblies 40 (FIGS. 3, 6 and 8), close to the opposite ends of the receptacle. Each terminal assembly 40 in this illustrative apparatus includes a clamp 42 for receiving an inserted conductor, a contact member 44, a pair of leaf springs 46, and a screw 48 for operating each clamp 42. Contact member 44 consists of a single resilient sheet-metal component comprising first and second contact pairs extending from a base portion. Each contact pair develops firm contact pressure against a respective blade of a fuse carrier 32. Each contact member 44 is secured in place in body 34. Screw 48 is threaded through the double-thickness top wall of each clamp 42 and each screw bears against base portion 44*c* (FIG. 6) of contact member 44, for tightening an inserted wire against the contact member.

As seen in FIGS. 2, 3, 6 and 8, a contact shield 50 of insulation is provided at each terminal assembly 40 of the receptacle. The shield is movable between one position covering its terminal assembly (at the right in FIG. 6) and a raised position (at the left in FIG. 6) for providing access to the screw fastener 42, 48 of its related terminal assembly 40. When the fuse holder is in an energized circuit, contact shields 50 of insulation cover the contacts to avoid hazardous exposure of the contacts when the fuse carrier is removed. Shield 50 has opposite-side pivots received in recesses in the receptacle walls 34*a*.

Fuse carrier 32 is receivable in receptacle 30 in the position shown or, as may be desired, fuse carrier 32 can be reversed end-to-end and inserted into the receptacle.

The fuse carrier 32 (FIG. 5) basically includes a body 56 that may comprise multiple parts of molded insulation, dual lever 58, and U-shaped contacts 62. Fuse 60 has terminal brackets comprising arms 60*a* and 60*b*. Each fuse terminal and contact 62 are fastened together and to body 56 by a screw, as shown. Body 56 has a shallow downward-facing cavity defined by end walls 57 (FIG. 5) and side walls 59 (FIG. 7), in which the fuse is partly recessed. Each contact 62 has a pair of parallel blades 62*a* that are tightly gripped by respective contact pairs of contact member 44 of the receptacle when the fuse holder is in use. The engaged areas of these contacts and the tightness of their grip increase with higher current ratings of the fuse (or fuses) for which the fuse holder is rated.

Dual lever 58 of the fuse carrier includes a top bridging portion 58*a* (see FIG. 1) that overlies body 56 and two parallel wide and thin and generally flat, resilient arms 58*b*. The outer surfaces of lever arms 58*b* are disposed against generally flat inner surfaces of the receptacle's side walls 34*a* when the fuse carrier is assembled to the receptacle. Aligned pivots 65 (integral portions of body 56) extend outward in opposite directions along an axis midway between contacts 62. Complementary holes in lever arms 58*b* receive pivots 65. The resilient lever arms 58*b* are forcibly spread apart when lever 58 is being assembled to pivots 65.

The top bridging portion 58*a* of the lever 58 has a cut-out (FIG. 1) that receives a generally complementary raised area 56*a* of body 56. Detents 58*c* fit in pits in formation 56*a* to hold the dual lever releasably in the position of FIG. 5 when the fuse carrier is free of the receptacle.

Raising lever 58 about its pivot 65 causes paired cams 58*e* to bear against mirror-image ribs 36 of the receptacle to drive the fuse carrier upward. A pair of contacts 62 at one end (or the other) of the fuse carrier are pried away from the companion contact assembly 40 of the receptacle. The grip of one of the fuse-carrier contacts 68 by the companion receptacle contact 40 is inevitably a little weaker at one end of the fuse holder than the grip of the mating contacts at the opposite end of the fuse holder. Consequently, the weaker grip initially results in release of one end of the fuse carrier while the grip at the opposite end is maintained. As the fuse carrier is being pried up, it tilts. Portions of the fuse carrier at one end of the fuse carrier are arrested by a related hooking abutment of the base 34. Thereafter, operation of the cam lever forces release of the second fuse-carrier contact 62 from the companion contact assembly 40 of the receptacle.

Lever 58 has ribs 58*g* flanking extension 58*f* of the lever. A grooved link 63 can be slid onto rib 58*e* of the illustrated fuse holder and the link can be slid onto the rib 58*g* of an identical adjacent pole of a fuse holder (not shown) when mounted against the side of the fuse holder that is shown in FIG. 1. In that way, the fuse holder shown can be converted into a multiple pole device.

The details of the above described fuse holder appear more fully in U.S. Pat. No. 4,966,561. The further description and drawings of that patent are incorporated herein by reference.

A fuse carrier of the form shown in the drawings, and a conventional fuse carrier as well (see FIGS. 32 and 33 in the '561 patent) can be equipped with a fuse and locked in the receptacle as a safeguard against the protected circuit being deenergized unintentionally, using a locking device 64 comprising clip 66 and padlock 68.

The fuse carrier can be locked in the receptacle in an "off" or open-circuit control condition by removing the fuse first, then using the locking device described below.

As a further alternative, a "dummy" fuse carrier may be used, lacking fuse 60 and lacking the contact 62 which is opposite to bridging portion 58*a* of the lever 58, preferably retaining contact 62 remote from bridging portion 58*a*; and in the dummy fuse carrier (as in common fuse holders that do not have lever 58) the lever can be omitted, the locking device then acting on the unitary body of the "dummy" fuse carrier.

Locking device 64 (FIGS. 1, 2 and 11) is used for locking the fuse holder 30, 32 of FIGS. 1–10 against removal of its fuse carrier 32. The locking device 64 includes a locking clip 66 (FIGS. 11–16) and a padlock 68. When the locking capability is to be utilized, clip 66 is inserted. The locking clip may form a permanent part of the fuse holder, as when the clip 66' of FIG. 17 (described below) is used. Locking clip 66 is readily removable after the need for locking the fuse holder is over, as explained below.

Clip 66 includes an external upward extending portion 66*a* having a hole 66*b* for receiving the hasp 68*a* of the padlock. Clip 66 also includes an offset portion 66*c* and an internal downward extending blade portion 66*d*, parallel to external portion 66*a* but spaced from it by offset portion 66*c*. Locating tips 66*e* extend downward from off-set portion 66*c*, spaced from blade 66*d*. Two detents 66*f* project to the left (FIG. 13) from the lower end of blade 66*d*, spaced downward from offset portion 66*c*.

Figure 11:
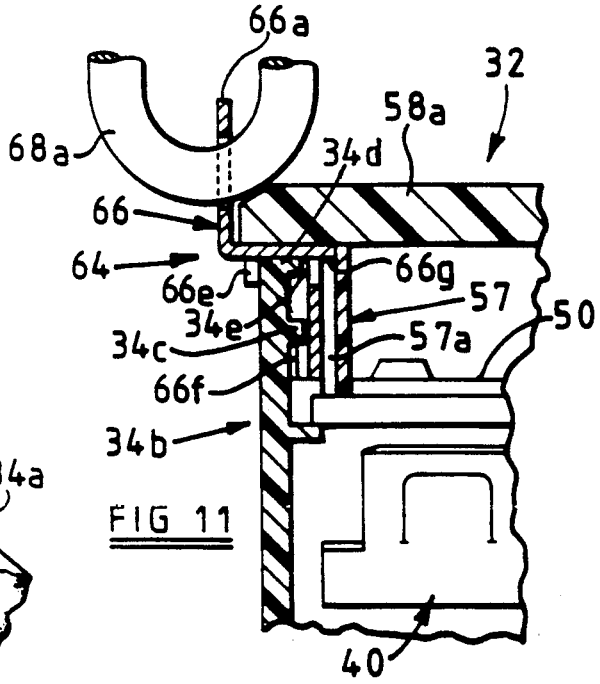
FIG. 11 is a fragmentary vertical cross-section of the fuse holder and the locking device of FIGS. 1 and 2, generally as viewed from the plane 10—10 in FIG. 2.
Figure 12:
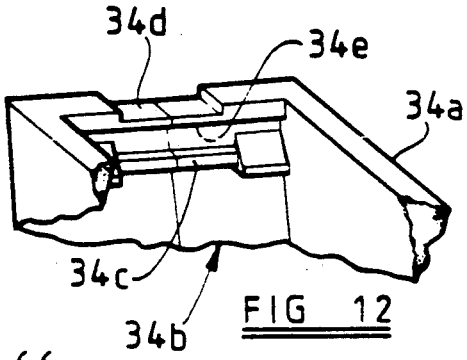
FIG. 12 is a fragmentary perspective view of the inside of each of the ends of the receptacle shown in FIGS. 2, 3 and 5.
Figure 13:
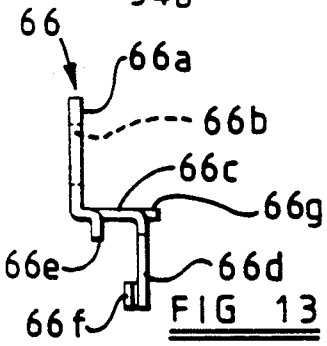
FIG. 13 is a side view of a locking clip, being part of the locking device of FIGS. 1, 2 and 11.
Figure 14:
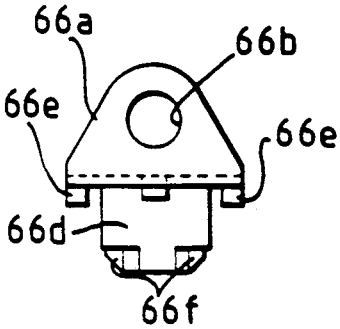
FIGS. 14 and 15 are a left-side and a bottom plan view, respectively, of the locking clip of FIG. 13.
Figure 15:
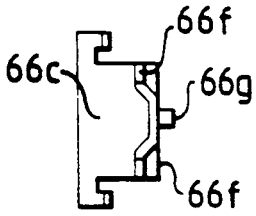
Figure 16:
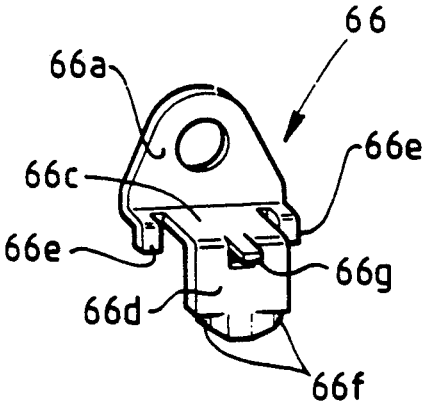
FIG. 16 is a perspective view as seen from the right and above of the locking clip shown in FIG. 13.

FIG. 12 shows an end wall 34*b* of receptacle 30, as seen from inside the cavity of the receptacle. Each end wall 34*b* has a rib 34*c* to be engaged by detents 66*f* when offset 66*c* rests on portion 34*d* of the receptacle end wall. Portion 34*d* (as viewed in FIG. 11) comprises the thickness of the end wall including rib 34*e*. The space between blade 66*d* and locating tips 66*e* is greater by a small amount than the thickness of the end wall 34*b* between them, providing a clearance or separation of (for example) 0.015 inch between end wall 34*b* and the surfaces of blade 66*d* and locating tips 66*e*. That clearance makes it easy to apply the clip to end wall 34*b* and to remove it, without requiring the clip to bend when bending assembled or removed.

When the locking device is to be used, clip 66 is assembled to end wall 34*b* of the receptacle 34 before the pull-out or fuse carrier 32 is inserted. While clip 66 is being assembled to the receptacle to assume the position shown in FIG. 11, the clip slants to the left. It is moved downward until the upper edge of the wall 34*b* is received between portions 66*d* and 66*e* of the clip; then the clip is moved clockwise until detents 66*f* underlie abutment rib 34*c*. This is the assembled condition of the clip and the receptacle.

The pull-out or fuse carrier, or the dummy described above, is then inserted into the receptacle. If the circuit is to be securely maintained "on", on the fuse carrier is to be equipped with a fuse 60. If the circuit is to be "open" or "off", the fuse is removed from the fuse carrier before the fuse carrier is plugged into the receptacle. Alternatively, a dummy fuse carrier (mentioned above) is used. Hasp 68*a* of padlock 68 is passed through hole 66*b* in clip 66. Hole 66*b* locates the hasp in position to obstruct the path of removal of the pull-out or fuse carrier 32, or of a dummy fuse carrier. When the padlock is in place, lever 58 in a sense becomes a blocked portion of the fuse carrier. Moreover, lever 58 in particular cannot be operated to pry the fuse carrier upward for releasing the tight grip of the fuse-carrier contacts 62 and the receptacle contacts 40. However, the padlock blocks the fuse carrier from being pulled out of the receptacle in any manner, as if it had no lever 58. As already stated, the locking device 64 is a safeguard against thoughtless removal of the fuse carrier, by anyone who might not be aware of any special status of the particular circuit protected by that fuse holder. When the fuse has been removed from the fuse carrier, a technician can work on the circuit protected by a padlocked fuse holder without fear of an uninformed person restoring power. When the fuse carrier is equipped with a fuse, the padlock guards against power being interrupted to a security circuit by an uninformed person.

Removal of the padlock restores the fuse holder to its usual condition, in which the fuse carrier is removable from the receptacle. This is done in the case of fuse holders of the form in FIGS. 1–10 by operating lever 58 to release the fuse-carrier contacts from the grip of the receptacle contacts. When the locking device is used with a common form of fuse holder such as that in FIGS. 22 and 33 of the '561 patent, removal of the padlock frees the fuse carrier to be pulled out of the receptacle. In the same sense, removal of the padlock frees the fuse carrier of FIGS. 1 and 2 for removal.

So long as the fuse carrier remains in place in the receptacle, with or without the padlock, the fuse clip remains captive in its position shown. The fuse carrier prevents clip 66 from being tilted counter-clockwise (FIG. 11), the motion necessary to free detents 66*f* from blocking cooperation with rib 34*c* (FIG. 11). Portion 57 of the fuse carrier (FIG. 11) and end wall 34*b* of the receptacle (FIGS. 11 and 12) provide confronting surfaces between which portion 66*d* of the clip (FIG. 13) is disposed when the fuse carrier is in the receptacle, in its control position. The interengagement of portions 34*c* and 66*f* can only be released by moving portion 66*d* away from end wall 34*b* of the receptacle; and that motion is blocked by portion 57 of the fuse receptacle while the fuse carrier is received in the receptacle. The surface of portion 57 of the fuse carrier which confronts the end wall portion 34*b* of the receptacle moves essentially along portion 66*d* of the clip as the fuse carrier is drawn out of the receptacle. That motion frees clip 66 to be tilted in that manner which frees portions 66*f* of the clip to be displaced from interengagement with portion 34*c* of the receptacle. When the fuse carrier has been lifted out of the receptacle, clip 66 can be tilted counter-clockwise (FIG. 11) until detents 66*f* are clear of rib 34*c*, and then removal of the clip leaves the fuse holder free of the locking device.

The fuse clip of FIGS. 1, 2 and 11–16 is ordinarily removed from the fuse holder after the need for a lock-off has passed, although it could be left in place.

Clip 66 has a projecting tooth 66*g* that is received in groove 57*a* in end wall 57 of the fuse carrier. Groove 57*a* is only provided in that end wall 57 of the fuse carrier which is directly other to the free end of lever 58; the other or remote end wall of the fuse carrier has no such groove. There is an advantage to fuse holders in which the fuse carrier can be inserted in either of its end-to-end reversed positions. However, after clip 66 is in place, only one end of the fuse carrier can be received in the receptacle, namely that end of the fuse carrier where bridging portion 58*a* of lever 58 is located. Consequently, the padlock will always block the lever. The end-to-end reversability of the fuse carrier remains in effect, because clip 66 can be fitted to either end of the receptacle.

Figure 17:
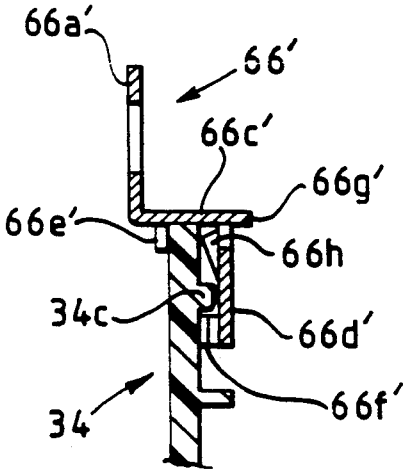
FIG. 17 is a vertical cross-section of a portion of the receptacle seen in FIG. 11 and a modified locking clip.

The form of locking clip in FIG. 17 can be used to maintain the clip in stable assembly to the receptacle even when the fuse carrier is not in the receptacle. Identical elements in FIGS. 1, 2 and 11–16 and in FIG. 17 have the same numerals, but in FIG. 17 the numerals are primed; their description is not repeated here. However, in FIG. 17 fuse clip 66' has a lance 66*h* that is struck out of blade 66*d'*, and rib 34*e* of FIGS. 11 and 12 is omitted in FIG. 17. End wall 34 of the receptacle is gripped between tips 66*e'* and lance 66*h*. Blade 66*d'* can have a pair of spaced apart lances 66*h*. Lance or lances 66*h* cause friction and bite into end wall 34*b* to resist removal of the clip, once it has been forced into assembly with the receptacle.

Figure 2:
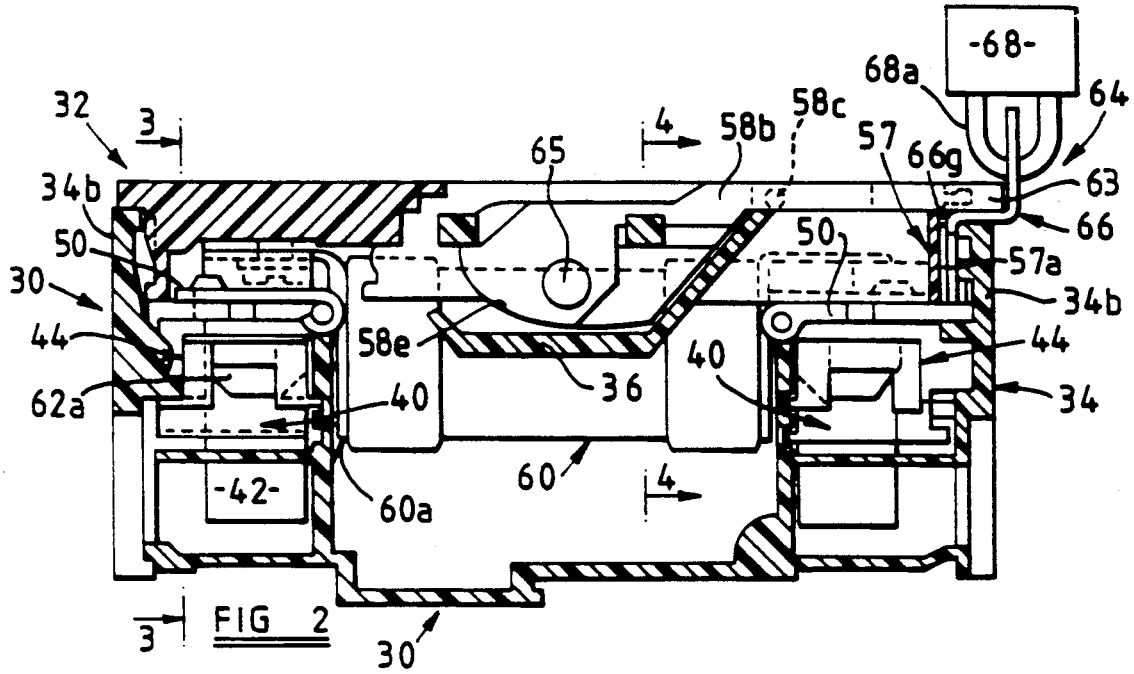
FIG. 2 is a vertical cross-section of the fuse holder and locking device of FIG. 1 as viewed from the broken section line 2—2 in FIG. 1.
Figure 3:
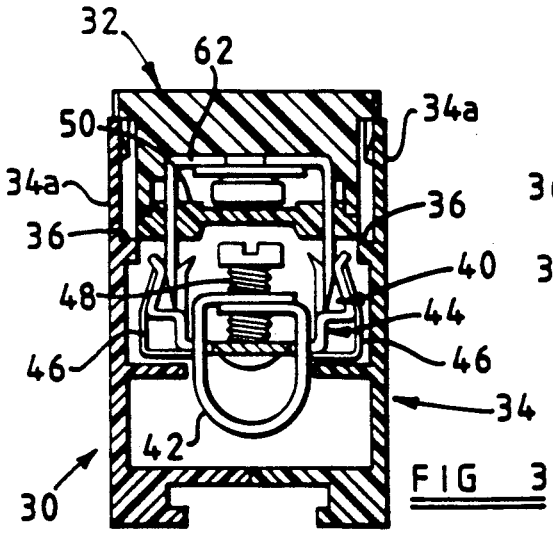
FIG. 3 is a cross-section of the fuse holder of FIGS. 1 and 2 as viewed from the plane 3—3 in FIG. 2.
Figure 4:
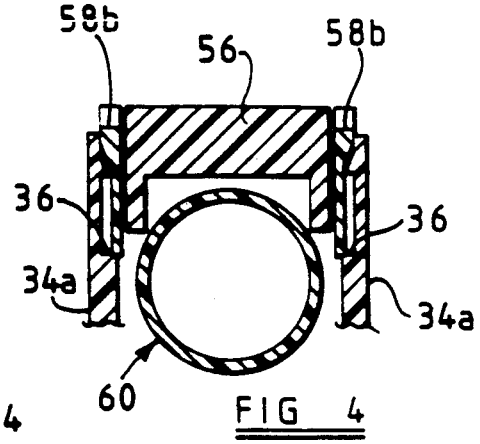
FIG. 4 is a fragmentary cross-section of the fuse holder of FIGS. 1-3 as viewed from the plane 4—4 in FIG. 2.
Figure 5:
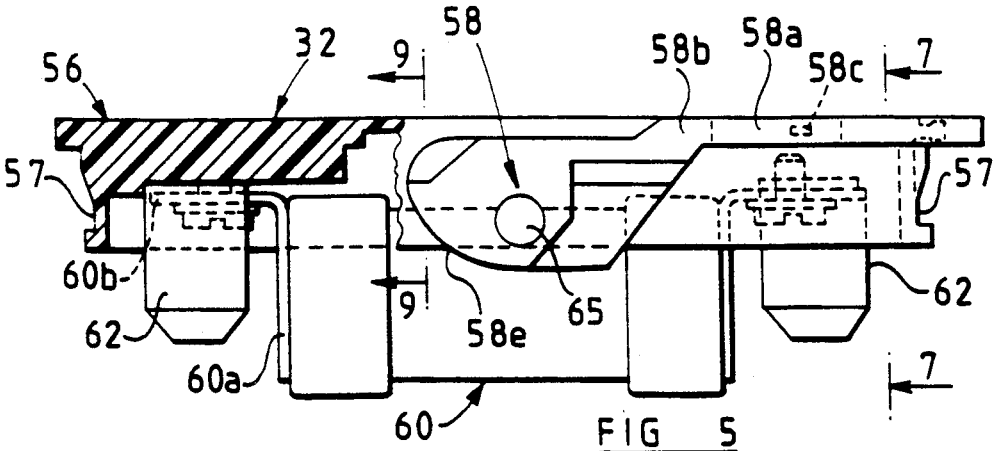
FIG. 5 is a lateral view of a fuse carrier, partly in cross-section, being one of two units forming the fuse holder of FIGS. 1-4.
Figure 6:
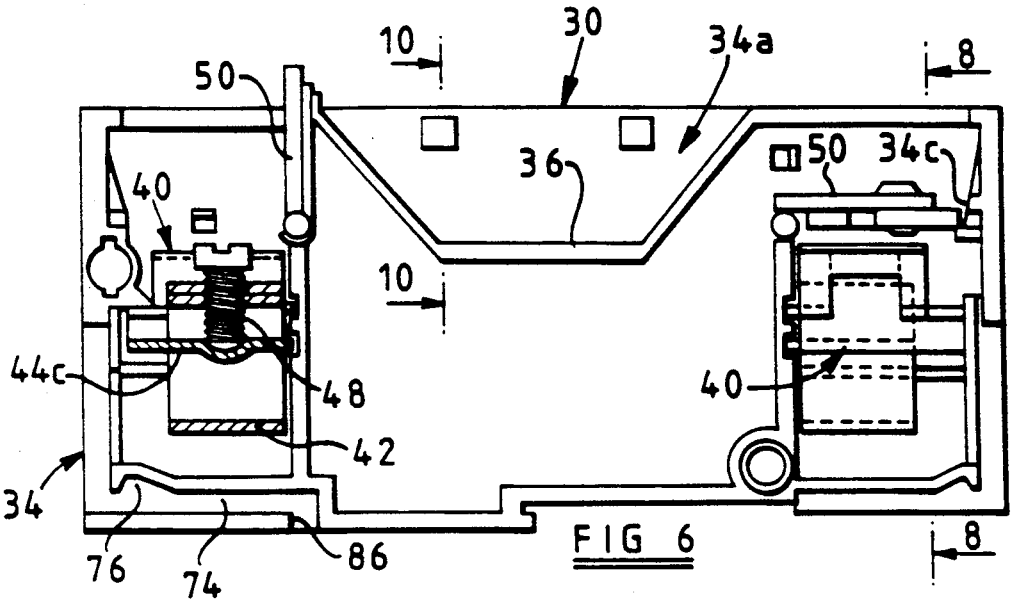
FIG. 6 is a lateral view of a receptacle for the fuse carrier of FIG. 5, partly in cross-section, being a second unit of the fuse holder of FIGS. 1-4, FIG. 6 omitting one side part of two basically mirror-image parts of the receptacle's base.
Figure 7:
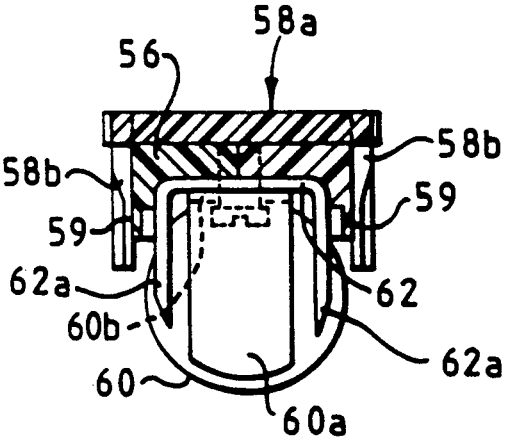
FIG. 7 is a vertical cross-section of the fuse carrier as viewed from the plane 7—7 in FIG. 5.
Figure 8:
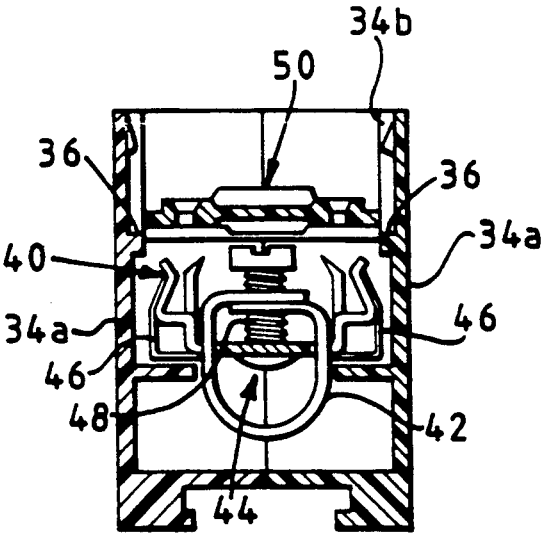
FIG. 8 is a vertical cross-section of the receptacle for the fuse carrier of FIG. 5, as viewed from the plane 8—8 in FIG. 6.
Figure 9:
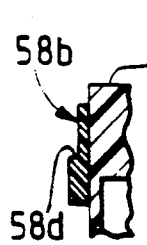
FIG. 9 is a fragmentary vertical cross-section of the fuse carrier as viewed from the plane 9—9 in FIG. 5.
Figure 10:
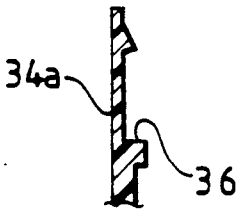
FIG. 10 is a fragmentary cross-section of the base of the receptacle as viewed from the plane 10—10 in FIG. 6.

When the clip is in use in the fuse holder in the manner shown in FIGS. 1 and 2, the fuse carrier blocks blade 66*d'* and its detents 66*f'* against release of clip 66' from the locking fit to receptacle wall 34*b*. Clip 66' can be removed from the receptacle if it should become necessary to do so. However, when the fuse carrier is in the receptacle, both clip 66 in FIGS. 1, 2 and 11–16 and clip 66' in FIG. 17 are blocked against removal. Moreover, both clips are interlocked with the receptacle and consequently they cannot move with a fuse carrier that is being removed.

The foregoing illustrative embodiment of the invention shown in the drawing has its own distinctive merit. Yet those skilled in the art will be able to modify the illustrative apparatus. Moreover, the novel aspects of the described illustrative embodiment will be adaptable to other forms of fuse holders and, more generally, to other electrical circuit protective and controlling apparatus. Consequently, the invention should be construed broadly in accordance with its true spirit and scope.

What is claimed is:

1. Electrical apparatus including a locking device, and, a fuse holder comprising a receptacle and a fuse carrier, said receptacle having an opening at which the fuse carrier may be inserted, said receptacle having a pair of contacts for energizing a circuit when said contacts are bridged, said fuse carrier being receivable in a control position in said receptacle and then being effective for determining whether the contacts of the receptacle are or are not bridged, thereby to determine whether the circuit is or is not energized, said locking device including a padlock having a hasp and including a clip interengageable with said receptacle and blocked by said fuse carrier against disengagement from said receptacle when the fuse carrier is in said control position, said clip including an external portion having a hole for receiving the hasp of the padlock and locating the hasp in a position blocking shift of the fuse carrier out of said control position.

2. Electrical apparatus as in claim 1, wherein said fuse carrier has a pair of fuse-carrier contacts engageable respectively with said fixed contacts.

3. Apparatus as in claim 2, wherein the fuse carrier includes a fuse that bridges said fuse-carrier contacts, the fuse and the fuse carrier being effective when the fuse carrier is in said control position to bridge said fixed contacts, whereby securing the padlock in said hole provides assurance of said circuit being protected against interruption by inadvertent removal of the fuse carrier.

4. Apparatus as in claim 2, wherein a part of the fuse carrier is a lever for acting against a portion of the receptacle to pry the fuse carrier's contacts away from the fixed contacts and wherein said clip locates said hasp in position blocking said lever.

5. Apparatus as in claim 2, wherein the movable contacts are free of a fuse whereby, when the fuse carrier is in said control position, a circuit in which said fixed contacts are interposed is deenergized, and securing the padlock in said hole provides assurance that the fuse carrier will not be used inadvertently to energize the circuit.

6. Apparatus as in claim 1, wherein said fuse carrier is free of means for bridging said fixed contacts and occupies said opening when in said control position so that, when the padlock is received in said hole in the clip, assurance is provided against inadvertent energization of the circuit.

7. Apparatus as in claim 1, wherein said clip is readily removable from said receptacle when said fuse carrier does not occupy said opening of the receptacle.

8. Apparatus as in claim 1, wherein means is provided for retaining said clip in interengagement with said receptacle when the fuse carrier does not occupy said opening of the receptacle.

9. Electrical apparatus as in claim 1 wherein said fuse carrier and said receptacle have respective first and second surfaces confronting each other when said fuse carrier is in said control position, a portion of said clip being captive between said surfaces when the fuse carrier is in said control position, said first surface being movable along said portion of the clip as the fuse carrier is moved into and out of said control position.

10. Electrical apparatus as in claim 1 wherein the receptacle has opposite ends with which the clip is selectively interengageable and wherein the fuse carrier is receivable in the receptacle in either of two end-to-end reversed positions, the hasp of the padlock when in the hole of the clip interengaged with either of said opposite ends of the receptacle being adapted to block release of the fuse carrier from the receptacle.

11. Electrical apparatus including a locking device and a circuit controlling device, the locking device including a clip and a padlock having a hasp, the circuit controlling device including a fixed unit and a movable unit, the movable unit being movable between a control position and another position, the movable unit when in said control position determining whether the controlled circuit is energized or deenergized, said clip being removably interengageable with said fixed unit and, when so interengaged, being blocked by a portion of said movable unit against disengagement from said fixed unit when the movable unit is in said control position, said portion of the movable unit being constrained to move with the remainder of the movable unit as the movable unit is moved into and out of said control position, said clip including an externally projecting portion having a hole for receiving the hasp of the padlock for locating the hasp in a position blocking the movable unit against shifting out of said control position.

12. Electrical apparatus as in claim 11, wherein said circuit controlling device is adapted to interpose a circuit interruption for rendering the controlled circuit deenergized when the movable unit is in its control position, so that locking the movable unit in that control position provides assurance of the controlled circuit remaining deenergized.

13. Electrical apparatus as in claim 11, wherein said circuit controlling device is adapted to provide an energizing connection to the controlled circuit when the movable unit is in said control position so that the locking device provides assurance against inadvertent deenergization of the controlled circuit.

14. Electrical apparatus as in claim 11, wherein removal of the movable unit from said control position frees the clip for being disengaged from the fixed unit.

15. Electrical apparatus including an electrical device and a locking device having a clip and having a padlock including a hasp, the electrical device including fixed and movable units having respective fixed and movable-unit contacts that are mutually engaged when the movable unit is in a control position, the contacts being disengaged when said movable unit is out of said control position, said clip being interengageable with said fixed unit and, when so interengaged, being blocked by a portion of said movable unit against disengagement from the fixed unit when said movable unit is in its control position, said portion of the movable unit being constrained to move with the remainder of the movable unit as the movable unit is moved into and out of said control position, said clip including an externally projecting portion having a hole for receiving the hasp of the padlock in a position for blocking the movable unit against being moved so as to disengage said contacts.

16. Electrical apparatus as in claim 15, wherein said clip and said fixed unit have mutually engageable portions that prevent shifting of the clip with the movable unit when the latter is being shifted for disengaging said contacts.

17. Electrical apparatus as in claim 15, wherein said clip is freed for disengagement from said fixed unit when it is not blocked by said movable unit against such disengagement.

18. Electrical apparatus as in claim 15, wherein said clip is free for disengagement from said fixed unit when said portion of said movable unit is not in position blocking disengagement of the clip from the fixed unit so that the locking clip can be applied to a receptacle when the locking capability is to be utilized and the locking clip can be removed otherwise, but wherein the locking clip is retentatively engaged with said fixed unit and arrested against moving with the movable unit when the movable unit is being moved out of its control position.

19. Electrical apparatus including a locking device and a circuit controlling device, the locking device including a clip and a padlock having a hasp, the circuit controlling device including a fixed unit and a movable unit, the movable unit being movable between a control position and another position, the movable unit when in said control position determining whether the controlled circuit is energized or deenergized, said clip being removably interengageable with said fixed unit and, when so interengaged, being blocked by said movable unit against disengagement from said fixed unit when the movable unit is in said control position, said clip including an externally projecting portion having a hole for receiving the hasp of the padlock for locating the hasp in a position blocking the movable unit against shifting out of said control position, said movable unit and said fixed unit having respective first and second surfaces confronting each other when said movable unit is in said control position, a portion of said clip being disposed between said surfaces when the movable unit is in said control position and the clip thereby being blocked against disengagement from the fixed unit as aforesaid, said first surface being movable essentially along said portion of said clip as the movable unit is moved between said control position and said disengaged position.

20. Electrical apparatus including an electrical device and a locking device having a clip and having a padlock including a hasp, the electrical device including fixed and movable units having respective fixed and movable-unit contacts that are mutually engaged when the movable unit is in a control position, the contacts being disengaged when said movable unit is out of said control position, said clip being interengageable with said fixed unit and, when so interengaged, being blocked by said movable unit against disengagement from the fixed unit when said movable unit is in its control position, said clip including an externally projecting portion having a hole for receiving the hasp of the padlock in position for blocking the movable unit against being moved so as to disengage said contacts, said movable unit and said fixed unit having respective first and second surfaces confronting each other when said movable unit is in said control position, a portion of said clip being disposed between said surfaces when the movable unit is in said control position and the clip thereby being blocked against disengagement from the fixed unit as aforesaid, said first surface being movable essentially along said portion of said clip as the movable unit is moved between said control position and said disengaged position.

* * * * *